United States Patent [19]

Morey

[11] Patent Number: 4,535,328

[45] Date of Patent: Aug. 13, 1985

[54] DIGITALLY CONTROLLED VECTOR GENERATOR FOR STROKE WRITTEN CRT DISPLAYS

[75] Inventor: William A. Morey, Marion, Iowa

[73] Assignee: Rockwell International Corporation, El Segundo, Calif.

[21] Appl. No.: 417,319

[22] Filed: Sep. 13, 1982

[51] Int. Cl.[3] ..... G09G 1/08

[52] U.S. Cl. ..... 340/739; 340/736

[58] Field of Search ..... 340/732, 736, 739, 742, 340/743, 740, 741

[56] References Cited

U.S. PATENT DOCUMENTS 3,824,382 7/1974 Eshelman ..... 340/739
3,921,163 11/1975 Giraud et al. ..... 340/739
4,001,806 1/1977 Sweeting ..... 340/739
4,032,768 6/1977 Rieger ..... 340/739
4,095,145 6/1978 Terranova et al. ..... 340/742

*Primary Examiner*—Gerald L. Brigance
*Attorney, Agent, or Firm*—Richard W. Anderson; Robert C. Mayes; George A. Montanye

[57] ABSTRACT

A system for developing horizontal and vertical deflection signals for drawing a vector of predetermined length and angle on the face of a cathode ray tube is disclosed. Variable rate integrators are caused to integrate at rates respectively definitive of the sine and cosine functions of the vector angle for a period of time which is proportional to the length of the vector to develop Y and X deflection signal outputs which collectively define the vector.

10 Claims, 4 Drawing Figures

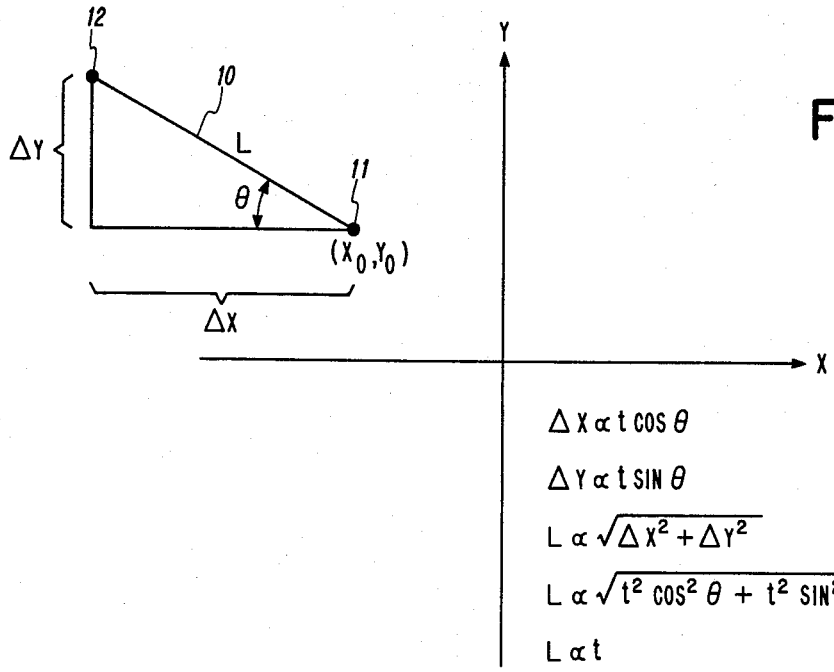

FIG. 3

$\Delta X \propto t \cos\theta$ $\Delta Y \propto t \sin\theta$ $L \propto \sqrt{\Delta X^2 + \Delta Y^2}$ $L \propto \sqrt{t^2 \cos^2\theta + t^2 \sin^2\theta}$ $L \propto t$

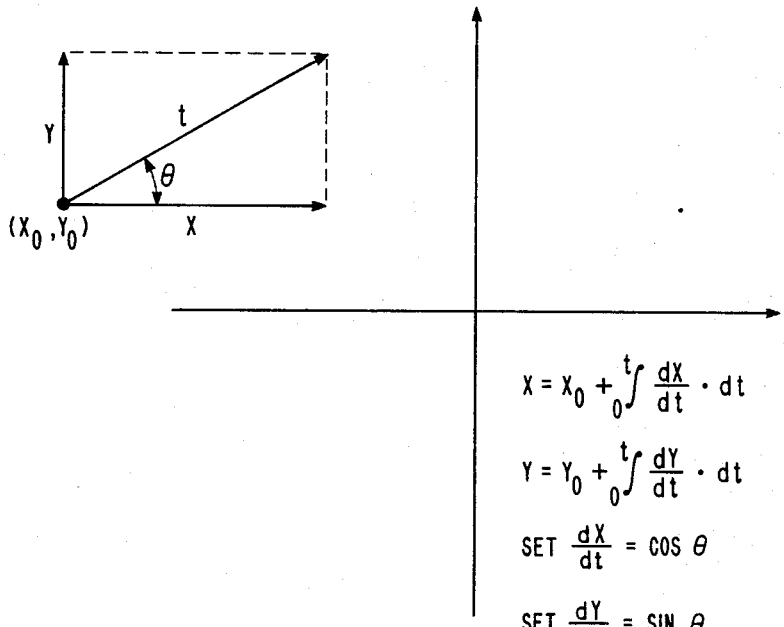

FIG. 4

$$X = X_0 + \int_0^t \frac{dX}{dt} \cdot dt$$

$$Y = Y_0 + \int_0^t \frac{dY}{dt} \cdot dt$$

$$\text{SET } \frac{dX}{dt} = \cos\theta$$

$$\text{SET } \frac{dY}{dt} = \sin\theta$$

$$X = X_0 + \int_0^t \cos\theta \, dt$$

$$Y = Y_0 + \int_0^t \sin\theta \, dt$$

DIGITALLY CONTROLLED VECTOR GENERATOR FOR STROKE WRITTEN CRT DISPLAYS

This invention relates generally to techniques of displaying graphics on a cathode ray tube screen. More particularly, the present invention relates to a deflection system useful in generating a line of predetermined length and slope from any starting point on the face of a cathode ray tube in a manner which reduces the computational requirements and high speed data processing requirements, which in turn significantly lowers the cost of the electronic components required to implement the function when compared to previously known schemes.

Known systems for generating deflection signals indicative of cathode ray tube X and Y deflection requirements operate on the basis of stroke writing, where the imagery to be and displayed is systematically defined as a sequence of strokes which when taken in sequence trace out a selected character or imagery on a cathode ray tube screen. These systems are controlled by readout of sequential stroke commands from a storage source.

A known digital alphanumeric stroke writing technique as described in U.S. Pat. No. 3,775,760 to Lyle R. Strathman, operates to generate running digital codes indicative of X and Y beam deflections to trace out a plurality of contiguous strokes so as to display alphanumeric characters. Here, each alphanumeric character to be displayed necessitates a storage requirement of a predetermined sequence of stroke words which collectively causes the beam to trace out the selected character. Systems of this type might be defined as "hard-wired" systems in that the display capability is completely defined by the predetermined storage and addressing sequences which are built into the design.

The storage requirements and sequencing time involved in the above type of system are considerably reduced by systems such as defined in Strathman U.S. Pat. No. 4,023,027 where, specifically, the storage necessary to define alphanumeric characters to be drawn on the face of the CRT comprises the polar angle of a given vector to be drawn and the length of that vector. For example, in Strathman 4,023,027, storage comprises to a relatively simple tangent table of angles and the number of incremented polar angles in the system is defined by the number of binary bits employed in the design. Here, addressing is simplified to that of addressing predetermined ones of tangent values from a storage ROM.

In systems of the above referenced type, clock rates are applied to respective counters which determine respective X and Y running digital deflection codes which cause the beam to trace out a commanded vector at its storage defined polar angle.

The present invention, in contradistinction to known CRT character writing devices, employs data storage defining the slope of a vector to be drawn, and, by employing variable rate integration of slope-defining values, develops X and Y deflection, the length of a vector to be drawn is directly proportional to how long the integration process is allowed to run. Specifically, variable rate integrators are employed for both X and Y deflection. The sine of the polar angle of the vector to be drawn is controllably inputted to the Y deflection integrator and the cosine of the polar angle of the vector to be drawn is selectively inputted to the X deflection integrator. The process involved permits a constant writing speed and uniform brightness on the cathode ray tube and considerably reduces the computation requirements and high speed data processing requirements as previously employed in stroke writing symbol generation schemes.

Accordingly, the primary object of the present invention is the provision of a system to draw various length lines at various angles at different points on a cathode ray tube display device which requires considerably less data storage to affect the drawing of symbology on the face of a cathode ray tube.

A further object of the present invention is the provision of a cathode ray tube stroke writing system which allows a constant beam writing speed and therefore uniform segment brightness of the characters to be displayed.

A still further object of the present invention is the provision of a cathode ray tube stroke writing system employing a variable rate integrating feature which permits the generation of contiguous vectors on the face of a cathode ray tube with the integrators employed providing the memory for keeping track of where the beam is positioned on the cathode ray tube, together with means for periodically refreshing this memory by resetting the integrators after predetermined portions of the symbology are drawn.

The present invention is featured in the provision of variable rate integrators to which the sine and cosine functions of the polar angle of a vector to be drawn of the face of the CRT are respectively inputted and which integrators are controlled to operate for a period of time which is definitive of the length of the vector to be drawn on the face of the CRT.

These and other objects and features of the present invention will become apparent on reading the following description with reference to the accompanying drawings in which:

FIG. 3 is a graphical representation depicting the operating principle of the present invention; and FIG. 4 is a further graphical representation depicting the operating principle of the present invention.

Figure 1:
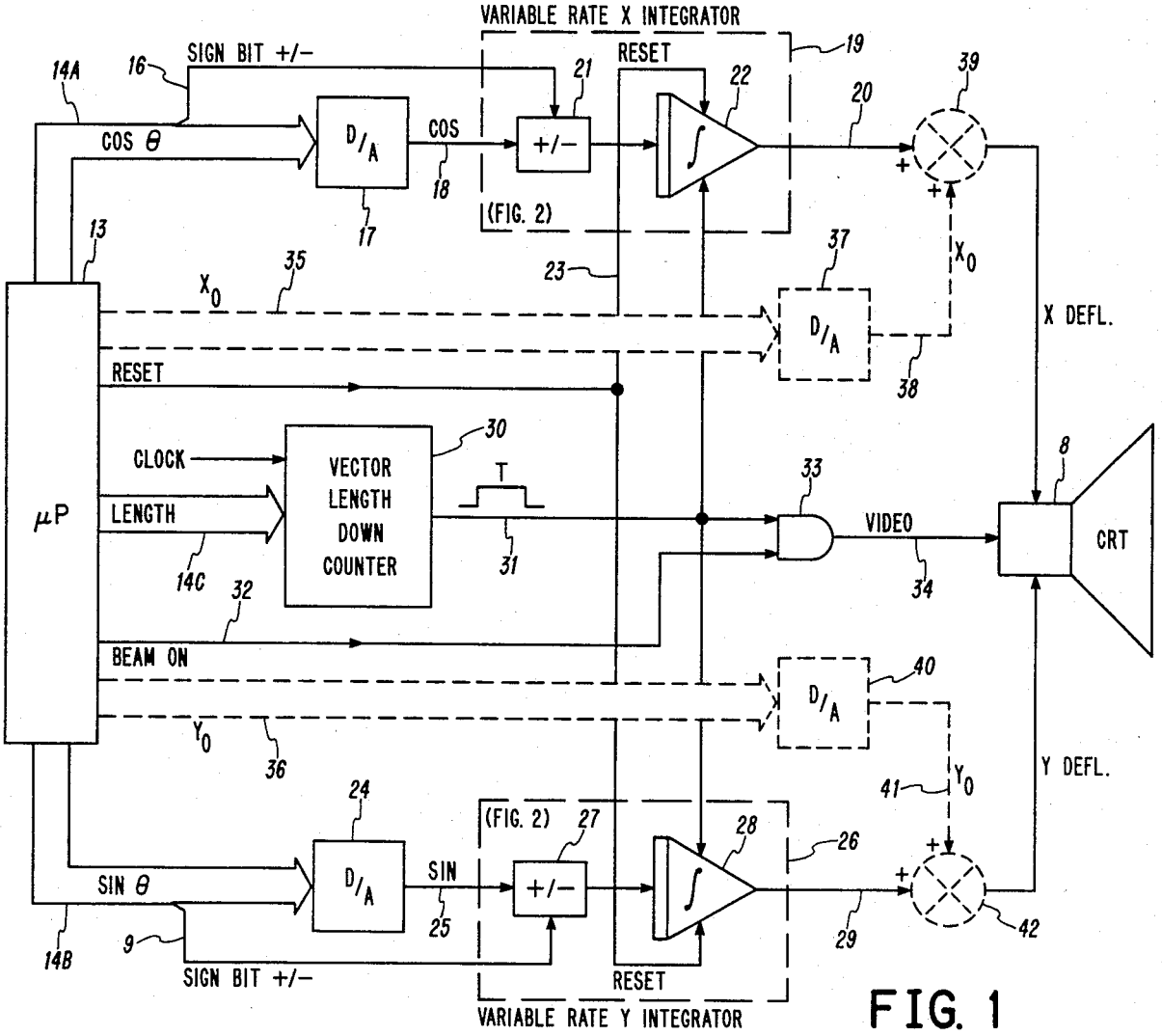
FIG. 1 is a functional diagram of a digital stroke writing system employing variable rate integration in accordance with the present invention.

The basic operating principle of the present invention is depicted in FIGS. 3 and 4. Referring 3, a vector 10 is graphically represented on the face of cathode ray tube as emanating from a position 11 defined by respective X and Y deflection signals $X_0$ and $Y_0$ and terminating at point 12 such that the vector 10 is a length L and is displayed at a polar angle $\theta$. In accordance with generalized stroke writing techniques, the vector is realized by generating a Y deflection signal which may incrementally be considered as $\Delta Y$, and an X deflection signal incrementally defined as $\Delta X$. From the geometry depicted in FIG. 3, the length L of the vector 11, is proportional to the square root of the sum of the squares of $\Delta X$ and $\Delta Y$. If then we equate the length L of the vector 10 as being proportional to time, we may write that $\Delta X$ is proportional to the product of time and the cosine of the polar angle $\theta$, while $\Delta Y$ is proportional to the product of time and the sine of the polar angle $\theta$. If then we express the length L in terms of the square root of the sum of the squares of t cosine $\theta$ and t sine $\theta$ respectively we see that length is proportional to time. Therefore, in accordance with the system to be described, the length of a particular vector to be drawn on the scope is determined by the controlling factor time (t). With reference to FIG. 4, a vector to be drawn is again displayed in terms of its respective rectangular coordinates X and Y. Again the vector is illustrated as being at a polar angle $\theta$ and emanating from a starting point defined by $X_0$, $Y_0$. From FIG. 4, we see that the cosine of $\theta$ is defined by dX/dt and the sine of $\theta$ is defined by dY/dt. The horizontal rectangular coordinate of the vector may then be expressed as:

$$x = x^o + \int_o^t \frac{dx}{dt} \cdot dt$$

The vertical rectangular coordinate of the vector may be expressed as:

$$y = y_o + \int_o^t \frac{dy}{dt} \cdot dt$$

Examination of the above expressions indicates that the expressions dX/dt and dY/dt might be defined by cosine $\theta$ and sine $\theta$ respectively. The expressions for X and Y rectangular coordinates depicted in FIG. 4 are then seen to be summation of the vector starting coordinates $X_0$ and $Y_0$ with respective integrations over a period of time t of cos $\theta$ dt and sin $\theta$ dt, respectively. Therefore, the present invention operates to develop signals definitive of the sine and cosine functions of the polar $\theta$ angle of a vector to be drawn and applies these signals to a respective variable rate integrator which is controlled to integrate over a controlled time interval t. As will be described, the integrators may be programmed by a microprocessor such that the rate at which the X channel integrates is proportional to the cosine of the angle at which the line is to be drawn, and the Y channel integrator rate is programmed similarly to the sine. The length of the line or vector to be drawn is controlled by programming a counter to put out a specific pulse width which is directly proportional to the length of the line. If the line or vector is to be drawn on the CRT screen (as opposed to merely affecting a starting position of a subsequent vector to be displayed) a beam-on signal may be provided by the microprocessor. The beam-on signal may be gated with the integrator on pulse or start pulse to synchronize the CRT video signal to the deflection signals.

As will be described, this scheme allows any length line to be drawn at any angle anywhere on the CRT screen and it will be seen that the integrators provide the memory for keeping track of where the beam is positioned on the CRT and that this memory may be refreshed at periodic intervals by resetting the integrators at the conclusion of the drawing of any particular vector whereupon the beam may subsequently be deflected to a predetermined point (without video on) to initiate the next portion of a symbology. The computations required by the microprocessor can then be limited to simple addition and subtraction of angles with a ROM look up table for sine and cosine data. As such the stroke writing system to be further described, in using a digitally controlled vector generator to draw lines, inherently eliminates the need to perform complex calculations to determine the starting or end point of moving lines on a display and inherently results in constant beam speed for uniform brightness across the face of the cathode ray tube.

Referring now to the general block diagram of the system as depicted in FIG. 1, the stroke writing system employing variable rate integration in accordance with the present invention is controlled by a microprocessor 13 which may be programmed to output digital information defining the cosine of the polar angle of a vector to be drawn on bus 14A, and the sine of the polar angle of a vector to be drawn on bus 14B each of which buses include a respective polarity or sign bit 16 and 9. A further microprocessor bus 14C outputs a digital word definitive of the length of the vector to be drawn on the cathode ray tube. The digital word in bus 14A definitive of cosine $\theta$ is applied to a digital-to-analog converter 17 to develop an analog output signal 18 proportional to cosine $\theta$. The sign bit 16 along with the analog signal 18 definitive of cosine $\theta$ are applied to an X variable rate integrator 19 the output 20 of which is applied as an X deflection signal to the cathode ray tube 8. Variable rate integrator 19 is depicted as functionally including a +/− control circuitry 21 which, as will be further described, operates to apply either a positive or negative cos $\theta$ value as input to an analog integrator circuitry 22 within the X variable rate integrator block 19. A reset input 23 is also functionally depicted as being applied to the integrator 22, this reset signal being selectively applied as a further output from the microprocessor 13.

In a paralleled arrangement, as depicted in FIG. 1, the microprocessor 13 outputs on bus 14B a digital word definitive of the sine of the polar angle of the vector to be drawn and this bus 14B may include a polarity definitive sign bit on line 9. The sin $\theta$ digital word on bus 14B is applied to a further digital to analog converter 24 which develops an analog output 25 definitive of sine $\theta$ for application to a Y variable rate integrator circuitry 26. Hereagain, as depicted in FIG. 1, the analog sin $\theta$ output on line 25 from the digital analog converter 24, along with the sign bit for the sine function of $\theta$ on line 9 are shown functionally as being applied as respective inputs to a +/− polarity control circuitry 27 within the Y integrator block 26 which operates to provide either a positive or negative polarity sine $\theta$ proportional signal as input to an integrator 28. Integrator 28 provides an analog output 29 which may be applied as the Y deflection of the signal to the cathode ray tube 21.

As thus far described, an X variable rate integrator in the upper portion of the block diagram of FIG. 1 is seen to have applied thereto an input signal definitive of the cosine of the polar angle of the vector to be drawn and with polarity defined by an accompanying sign bit 9 from the microprocessor, which polarity is definitive of the quadrant within which the polar angle $\theta$ lies. Similarly in the lower portion of FIG. 1, a signal definitive of the sine of the polar angle of the vector to be drawn along with an accompanying sign bit 16 is applied as inputs to the Y variable rate integrator with a polarity defined by the quadrant within which the polar angle $\theta$ lies.

In accordance with the present invention, the respective X and Y variable rate integrators 19 and 26 are caused to operate for a period of time which is definitive of the length of the vector to be drawn. For this purpose, the microprocessor 13 outputs on a further bus 14C a digital word definitive of the length of the vector to be drawn. As depicted in FIG. 1, the length of the vector to be drawn is controlled by programming a counter 30 to output a specific pulse 31 whose width is directly proportional to the length of the vector to be drawn. The length counter 30 may be preset to a count defined by length digital input 14C and count down at a clock define rate so as to develop an output pulse T on line 31, the pulse width of which is definitive of the length of the vector to be drawn. The time pulse on line 31 is applied as a controlling input to X variable rate integrator 19 and Y variable rate integrator 26 and, as will be further described, operates to apply the respective cosine $\theta$ and sine $\theta$ definitive analog inputs to these respective integrators for a period of time determined by the width of the time pulse on line 31.

A beam-on control signal is provided from the microprocessor on line 32 as a first input to an AND gate 33. The second input to AND gate 33 comprises the time pulse on line 31. Thus the beam-on signal on line 32 from the microprocessor 13 is gated with the integrator on pulse (the time pulse on line 31) to synchronize the CRT video signal to the deflection signals. If the vector is to be displayed on the face of the CRT, the beam-on signal 32 operates to turn on the video for the duration of the time pulse 31. If the deflection vector is employed to position the cathode ray tube beam to a starting point on the screen, the beam-on pulse is not affective in turning on the video.

It is to be realized that the system depicted in FIG. 1 and as thus described may be utilized to generate respective X and Y deflection signals which cause the beam of the cathode ray tube 9 to be deflected in vector fashion from any desired starting point on the face of a cathode ray tube beam in any desired direction from that starting point and for a distance, or vector length which may be selectively controlled. If the deflection vector, as collectively defined by the X and Y deflection signals applied to the CRT 8, is to be displayed as a line on the face of the cathode ray tube 9, the beam-on signal 32 from the microprocessor 13 is affected to turn the video on for the duration of the vector length time pulse on line 31. However, should it be wished to position the cathode ray tube beam in vector fashion from any one point on the cathode ray tube to any other point on the cathode ray tube but without displaying the vector as a line on the face of the tube, the beam-on signal 32 may be effective in turning off the video for this duration of time. This function is useful in positioning the beam from an initial starting point to any point on the screen for the initiation of the drawing of a vector or a sequence of vectors which define an alphanumeric character to be displayed.

The system functionally depicted in FIG. 1 indicates in phantom line the inclusion of an alternate means for controlling initial starting points of vectors to be displayed. The microprocessor 13 may alternatively supply digital words on output buses 35 and 36 respectively definitive of $X_0$ and $Y_0$ vector starting point coordinates. The $X_0$ starting point 35 may be applied to a further digital to analog converter 37 the output 38 of which defines an $X_0$ starting point which may be summed in adder 39 with the analog X deflection rectangular coordinate output 20 from the X variable rate integrator. The output 40 from summer 39 then effects an X deflection signal which is the summation of a starting point $X_0$ plus the output 20 of integrator 19. In similar fashion, a $Y_0$ binary word on bus 36 from the microprocessor 13 may be applied to a digital-to-analog converter 40 to develop an analog output on line 41 for summation in adder 42 with the output 29 from the Y variable rate integrator, whereby the output from adder 42 serves as the Y deflection of signal. Elimination of the alternative vector starting point inputs $X_0$ and $Y_0$ may cause a sacrifice in the quantity of data that can be displayed with a given refresh rate, which sacrifice may not necessarily detrimentally affect a particular implementation of the stroke writing system. As previously mentioned, the system need not include starting point coordinates $X_0$ and $Y_0$ by simply allowing the respective X and Y integrators to be programmed to do the initial beam positioning to desired starting points for subsequent vector display.

Figure 2:
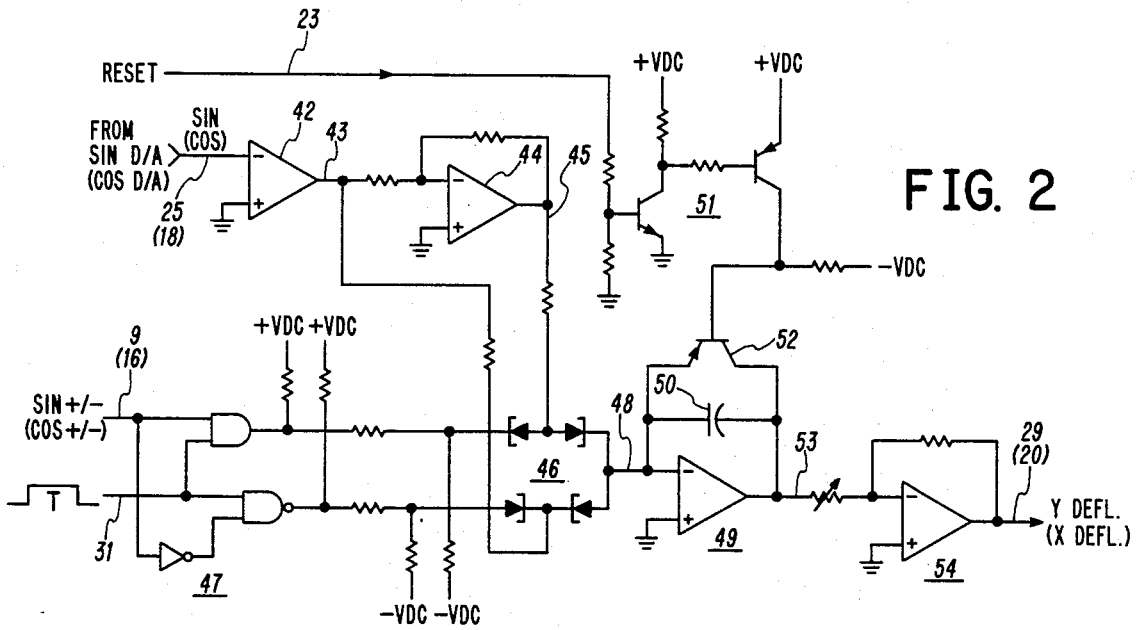
FIG. 2 is a schematic representation of a type of variable rate integrator which may be employed in the present invention.

Reference is now made to FIG. 2 which schematically depicts an implementation of the X variable rate integrator 19 and Y variable rate integrator 26 functionally depicted in FIG. 1. As previously functionally described, each of these integrators, which may comprise identical circuitries, operates to apply an appropriately signed input to an integrator circuit for a predetermined period of time, with provision for periodic reset of the integrator circuit outputs to zero as controlled by the microprocessor 13. General operation of the circuit of FIG. 2 will now be described with reference to its incorporation as the Y variable rate integrator 26 depicted functionally in FIG. 1. The output 25 from the digital to analog integrator 24 in the lower portion of FIG. 1 is applied to an inverting amplifier 42 whose output 43 is applied to a further inverting amplifier 45 such that the signals on the respective inverting amplifier outputs 43 and 45 represent respective oppositely-signed signals definitive of the sine of the polar angle $\theta$. These respective oppositely signed outputs 43 and 45 are applied to a steering diode bridge arrangement 46 through which they are controllably and selectively applied as the input 48 to an integrator circuitry 49 in the form of either a positive or a negative step input proportional to the sine function of the polar angle of the vector to be drawn. Which of these respectively oppositely polarized signals 43 and 45 is applied as input to the integrator 49 is controlled by the sign of the sine $\theta$ bit provided by the microprocessor on line 9, and the time during which either output 43 or 45 is applied to the integrator 49 is determined by the duration of the time pulse 31 from counter 30 in FIG. 1. The steering and time control function is accomplished by applying the sine +/− signal on line 9 and the time pulse on line 31 to a logic circuitry 47 which effects selective enabling and time-controlled biasing of the steering diode network 46, whereby one or the other of the respectively oppositely polarized outputs 43 and 45 from inverting amplifiers 42 and 44 is applied as input 48 to the integrator 49 for a duration of time determined by the pulse width of the time pulse 31.

Reset of the integrator 49 in FIG. 2 is accomplished by applying the reset pulse on line 23 to a transistor control circuitry 51 which is effective in turning on switching transistor 52 to provide a low impedance shunt across the capacitor 50 associated with the integrator 50 and thus dumping the integrator output 53 to zero. The output 53 from integrator 49 is shown applied to a further inverting amplifier 54 with the output 29 from amplifier 54 comprising the Y deflection signal as applied to the cathode ray tube 21 of FIG. 1. Amplifier 54 provides a means by which the gain scaling of the integrators 26 (19) may be calibrated.

Circuitry of FIG. 2 is also utilized for the X variable rate integrator 19 in the upper portion of FIG. 1. In this instance, the cosine $\theta$ analog output 18 from digital to analog converter 17 is applied as input to the inverting amplifier 42 of FIG. 2, the algebraic sign of cosine $\theta$ on line 16 is applied as input to the logic circuitry 47 of FIG. 2 along with the time pulse on line 31, and the output 20 from the X variable rate integrator 19 in FIG. 1 is applied as the X deflection signal to the cathode ray rube 21.

The present invention thus provides a means for developing X and Y deflection signals for a cathode ray tube by means of which the cathode ray tube beam is caused to be deflected vectorially along a vector path from any desired starting point on the cathode ray tube, with the vector exhibiting a controlled vector angle and length. The system described further permits the video to be synchronized with the X and Y deflection signals such that as the beam is deflected along the prescribed vector path the vector is selectively displayed or not displayed. Lack of vector display is useful in positioning the beam to a starting position from which an ensuing contiguous vector is wished to be displayed. The described system utilizes variable rate integrators to which vector slope definitive sine and cosine functions of the polar angle are respectively inputted with appropriate polarity whereby the integrator rates are defined by the magnitude of the sine and cosine input functions for controlled periods of time to generate X and Y deflection signals effective in tracing out a vector of predetermined polar angle and length. The integrators themselves provide the memory for keeping track of where the beam is positioned on the cathode ray tube and this memory may be refreshed at occasional intervals by resetting the integrators after portions of the picture are drawn thus eliminating the inherent problems of integrator drift associated with analog integrators or quantization errors associated with digital integration.

Although this invention has been described with respect to a particular embodiment thereof, it is not to be so limited as changes might be made therein which fall within the scope of the invention as defined in the appended claims.

I claim:

1. An open loop system for developing deflection signals effective to position the beam of a cathode ray tube to impact the face of said cathode ray tube along a predetermined vector path comprising first and second signal integrating means;

means for developing first and second signals respectively proportional to the sine and cosine functions of the polar angle defining the slope of said vector;

means for applying said sine and cosine functions as respective inputs to said first and second signal integrator means;

means for enabling each of said first and second integrators as a direct function of time proportional to the length of said vector;

means for applying, for said period of time, the outputs of said first and second signal integrator means as respective inputs to the vertical and horizontal deflection signal generating means of said cathode ray tube; and means for selectively resetting each of said first and second signal integrating means to zero at reset times exclusive of said period of time during which said integrators are integrating.

2. The system as defined in claim 1, comprising means for applying said sine and cosine functions as inputs to said first and second integrators with respective polarities defined by the quadrant of said vector polar angle.

3. The system as defined in claim 2 further comprising means for selectively resetting each of said first and second signal integrating means to zero at reset times exclusive of said period of time during which said integrators are integrating.

4. The system as defined in claim 3 wherein said signals proportional to said sine and cosine functions and those signals affecting integrator reset, vector length, and video (beam) beam on-off, are provided as outputs from a digital computer.

5. The system as defined in claim 4 wherein said digital computer provides sequential output effective to position the beam of said cathode ray tube along preselected contiguous vector paths, with said digital computer providing a video on-off signal to selectively enable and disable the beam generating means of said cathode ray tube whereby contiguous deflection vectors each of which may be selectively displayed on the face of said cathode ray tube which collectively display an alphanumeric character on the face of said cathode ray tube.

6. The system as defined in claim 5 with said digital computer further providing a reset signal at the conclusion of selected ones of said integrator enablement times with means for applying said reset signal to each of said first and second integrators to reset said integrators to zero output.

7. The system as defined in claim 6 wherein said digital computer provides multibit digital words definitive of the sine and cosine functions of the polar angle of said vector, said digital words being applied to respective digital to analog conversion means, and means for applying the outputs from said respective digital to analog conversion means for a period of time proportional to the length of said vector as respective inputs to said first and second integrators with polarities defined by the quadrant within which the vector polar angle lies.

8. The system as defined in claim 1 further comprising means for selectively enabling the beam generation means of said cathode ray tube for the duration of said period of time.

9. The system as defined in claim 1 comprising binary counting means, means for presetting said binary counting means to a binary count definitive of said period of time, means for clocking said counter from said preset count to zero count at a predetermined clock rate to provide a time gate output corresponding to said period of time, and means for gating said sine and cosine definitive signals to said first and second signal integrating means for the duration of said time gate.

10. The system as defined in claim 1 further comprising means for developing signals respectively defining a cathode ray tube face starting position, $X_0$ $Y_0$, means for summing said $X_0$ and $Y_0$ definitive signals with the respective outputs from said first and second signal integrating means, and means applying said summations as respective horizontal and vertical deflection signals to said cathode ray tube.

* * * * *